US007040970B2

(12) United States Patent
McClatchie et al.

(10) Patent No.: US 7,040,970 B2
(45) Date of Patent: May 9, 2006

(54) APPARATUS AND METHOD FOR DISTRIBUTING A POLISHING FLUID

(75) Inventors: Simon McClatchie, Fremont, CA (US); Sabir Majumder, Fremont, CA (US); Ren Zhou, Fremont, CA (US); Xuyen Pham, Fremont, CA (US); Tuan A. Nguyen, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/892,428

(22) Filed: Jul. 15, 2004

(65) Prior Publication Data

US 2006/0014478 A1 Jan. 19, 2006

(51) Int. Cl.
*B24B 1/00* (2006.01)

(52) U.S. Cl. ..... 451/60; 451/285

(58) Field of Classification Search ..... 451/41, 451/285, 287, 286, 288, 289, 42, 36, 56, 451/60

See application file for complete search history.

(56) References Cited

U.S. PATENT DOCUMENTS

| | | | | |
|---|---|---|---|---|
| 5,928,062 | A * | 7/1999 | Miller et al. | 451/41 |
| 2002/0173233 | A1* | 11/2002 | Griffin et al. | 451/8 |
| 2003/0017706 | A1* | 1/2003 | Moore et al. | 438/692 |
| 2003/0199234 | A1* | 10/2003 | Chen et al. | 451/41 |
| 2004/0132386 | A1* | 7/2004 | Tanoue et al. | 451/41 |
| 2005/0070212 | A1* | 3/2005 | Pham et al. | 451/36 |

* cited by examiner

*Primary Examiner*—Jacob K. Ackun, Jr.
(74) *Attorney, Agent, or Firm*—Brinks Hofer Gilson & Lione

(57) ABSTRACT

An apparatus and method for evenly distributing a polishing fluid onto a polishing pad during a chemical mechanical planarization process, wherein the polishing fluid is dispersed by way of a spray being emitted from a spray nozzle. The pattern of polishing fluid applied to the polishing pad can be modified by adjustment of geometric parameters of the spray nozzle. The apparatus is configured with actuating mechanisms for translating and rotating the spray nozzle relative to the polishing pad in order to adjust a pattern of distribution of the polishing fluid. The method of dispersing polishing fluid onto the polishing pad produces an even distribution of polishing fluid across a width of the polishing pad.

1 Claim, 9 Drawing Sheets

APPARATUS AND METHOD FOR DISTRIBUTING A POLISHING FLUID

FIELD OF THE INVENTION

This invention relates to chemical mechanical planarization (CMP) systems, and more particularly, to an apparatus and a method for evenly distributing a polishing fluid.

BACKGROUND

Semiconductor wafers are typically fabricated with multiple copies of a desired integrated circuit design that will later be separated and made into individual chips. A common technique for forming the circuitry on a semiconductor wafer is photolithography. Part of the photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive for smaller, more highly integrated circuit designs which cannot tolerate certain nonuniformities within a particular die or between a plurality of dies on a wafer. Because semiconductor circuits on wafers are commonly constructed in layers, where a portion of a circuit is created on a first layer and conductive vias connect it to a portion of the circuit on the next layer, each layer can add or create nonuniformity on the wafer that must be smoothed out before generating the next layer.

Chemical mechanical planarization (CMP) techniques are used to planarize the raw wafer and each layer of material added thereafter. Available CMP systems, commonly called wafer polishers, often use a rotating wafer holder that brings the wafer into contact with a polishing pad moving in the plane of the wafer surface to be planarized. The polishing pad used in the CMP process is typically a disk or a belt. In some systems, a polishing fluid, such as a chemical polishing agent or a slurry containing microabrasives, hereinafter referred to as a slurry for simplicity, is applied to the polishing pad to polish the wafer. The wafer holder then presses the wafer against the rotating polishing pad and is rotated to polish and planarize the wafer in order to create a smooth surface and remove any nonuniformities. The surface of the wafer is often completely covered by, and in contact with, the polishing pad to simultaneously polish the entire wafer surface.

Typical slurry dispensing systems include an elongated member, or manifold, located above the polishing surface of the polishing pad. The manifold has a plurality of nozzles formed thereon, or attached thereto, from which slurry is applied to the polishing pad by using a dripping method where the slurry is dripped onto the polishing pad from the nozzles, as shown in FIGS. 9 and 10B. As the slurry is dripped onto the polishing pad, trails of slurry are formed on the polishing pad. These trails of slurry are not distributed over the surface of the polishing pad until the trail comes into contact with the rotating wafer during the CMP process. One drawback to this method of slurry distribution is that these trails tend to cause an uneven wear rate across the surface of the wafer due to the fact that a large portion of slurry is concentrated at particular points along the polishing pad, and each of these trails is only dispersed over the surface of the polishing pad by the rotation of the wafer. This can cause rings of greater wear to form on the surface of the wafer as the wafer is rotated, which results in an uneven wear profile of the wafer surface. An uneven wear profile can cause problems for subsequent steps of semiconductor wafer production because the surface of the wafer is not smooth. Additionally, because the trails that are formed on the polishing pad have increased amounts of slurry, the life of the polishing pad is decreased due to the added wear that occurs as a result of the frictional contact between the rotating wafer and the moving polishing pad having localized areas of increased amounts of slurry. Accordingly, there is a need for a method and system to provide an even distribution of slurry onto the polishing surface of the polishing pad.

BRIEF SUMMARY

According to a first aspect of the present invention, a fluid distribution apparatus for distributing a polishing fluid onto a polishing pad for chemical mechanical planarization is provided. The apparatus includes a vertical support disposed adjacent to an edge of the polishing pad, a mounting member operatively connected to the vertical support, a main body connected to the mounting member, and a spray tip attached to the main body. The spray tip has at least one aperture formed therethrough for dispersing the polishing fluid in the direction of the polishing pad.

According to another aspect of the present invention, the spray of polishing fluid is configured to have a fan-shaped dispersement between the spray tip and the polishing pad. In a further aspect of the present invention, the fan-shaped spray is further configured to evenly distribute the polishing fluid onto the polishing pad thereby forming a pattern thereon. The pattern of polishing fluid on the polishing pad is a swath having a width relative to the edges of the polishing pad.

According to a further aspect of the present invention, the apparatus includes mechanisms that provide for the longitudinal, lateral, and vertical translation relative to the polishing pad of a carrier member to which the spray nozzle is attached. Additionally, the spray nozzle is also capable of rotational adjustment relative to the carrier member.

In yet another aspect of the present invention, a method for distributing a polishing fluid onto a polishing pad is provided. The method includes providing a vertical support adjacent to an edge of the polishing pad. The method also includes providing a spray nozzle operatively connected to the vertical support. The method further includes distributing the polishing fluid from the spray nozzle onto the polishing pad such that the polishing fluid is evenly distributed on the polishing pad and the polishing fluid forms a pattern on the polishing pad having a width relative to the edges of the polishing pad.

DETAILED DESCRIPTION OF THE DRAWINGS AND THE PRESENTLY PREFERRED EMBODIMENTS

A method and assembly for dispensing a polishing fluid during chemical-mechanical planarization (CMP), and in particular during linear planarization, is described. In the following description, numerous specific details are set forth, such as specific structures, materials, polishing techniques, etc., in order to provide a thorough understanding of the present invention. However, it will be appreciated by one skilled in the art that the present invention is not limited to the specific examples disclosed. In other instances, well known techniques and structures have not been described in detail in order not to obscure the present invention. Although one embodiment of the present invention is described in reference to a linear polisher, other types of polishers, such as rotary polishers, are also contemplated. Furthermore, although the present invention is described in reference to performing a CMP process on a semiconductor wafer, the invention is adaptable for polishing other materials as well.

Figure 1:
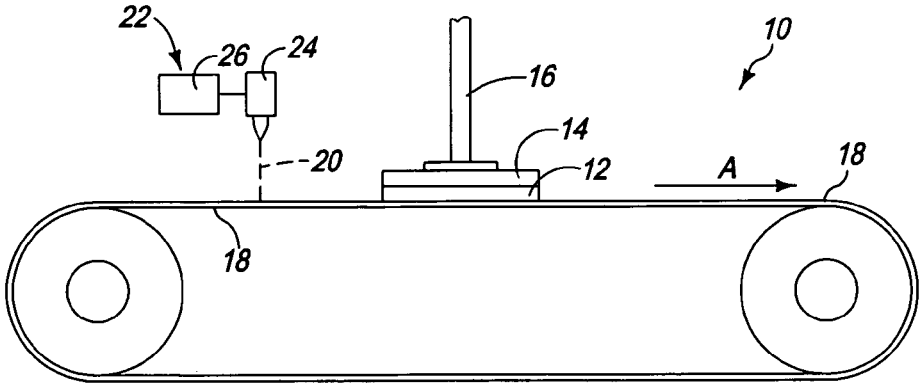
FIG. 1 is a side view of the wafer polisher according to one embodiment.
Figure 2:
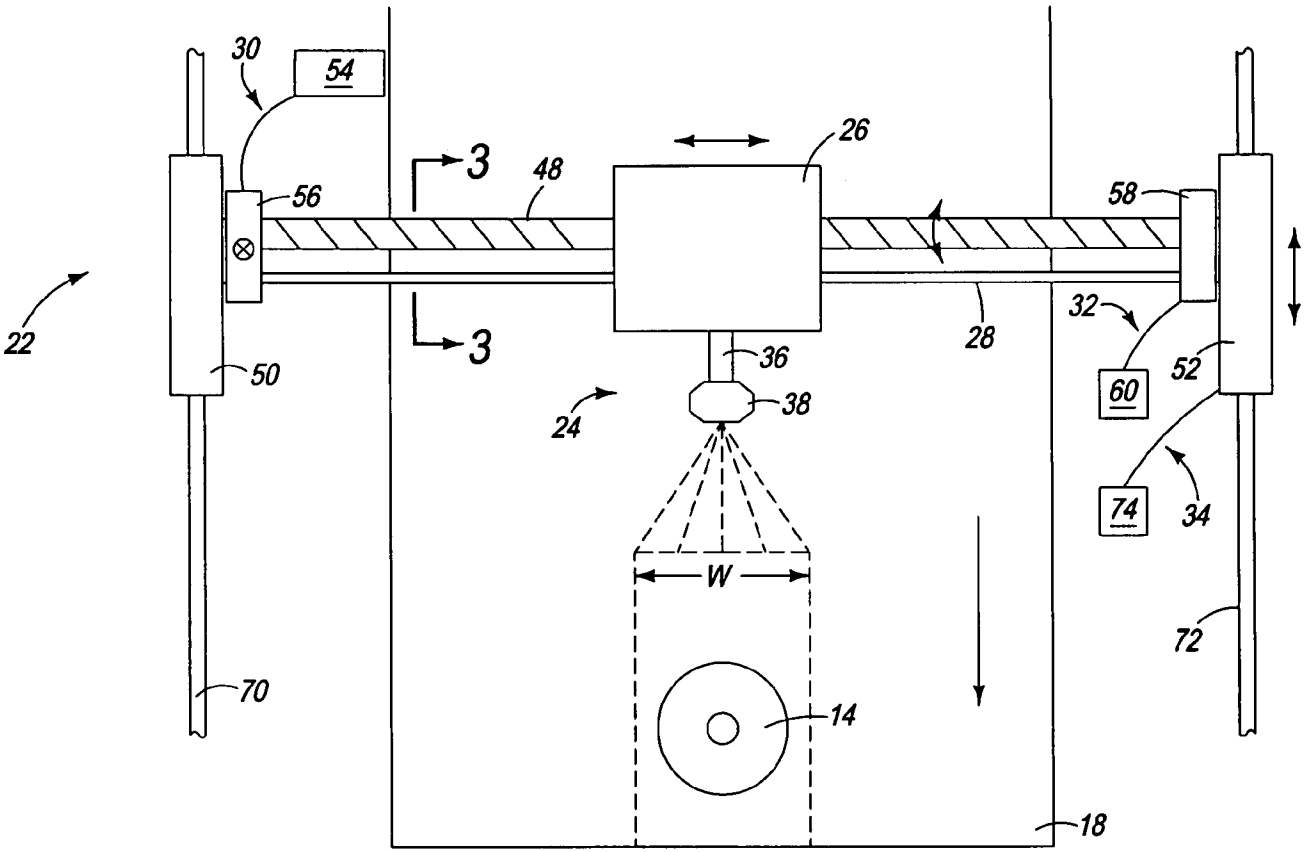
FIG. 2 is a top sectional view of the wafer polisher.

Referring to FIGS. 1 and 2, a wafer polisher 10, or CMP system, for use in chemical-mechanical planarization of a semiconductor wafer 12 is shown. The wafer polisher 10 is utilized in polishing a semiconductor wafer 12, such as a silicon wafer, to polish away materials and residue on the surface of the semiconductor wafer 12. The wafer polisher 10 may be any device that provides planarization to a substrate surface, and therefore can include, but is not limited to, systems such as a linear polisher, a radial polisher, and an orbital polisher. In an exemplary embodiment, a wafer polisher 10 includes a rotating wafer carrier 14 attached to a shaft 16 that brings a semiconductor wafer 12 into contact with a polishing pad 18 moving in a linear direction A in the plane of the semiconductor wafer surface to be planarized. The wafer carrier 14 then presses the semiconductor wafer 12 against the surface of the moving, linear polishing pad 18 and the semiconductor wafer 12 is rotated to be polished and planarized. A polishing fluid, such as a slurry 20, is dispensed by a slurry dispensing mechanism 22 onto the polishing surface of the polishing pad 18 to aid in removing substrate from the semiconductor wafer 12 during the CMP process. It should be understood by one skilled in the art that the polishing fluid can be a homogenous liquid, a colloid containing microabrasives, or any other type of fluid sufficient to assist in the planarization of the surface of a semiconductor wafer 12. The polishing fluid will be referred to as a slurry hereinafter for convenience.

Figure 3:
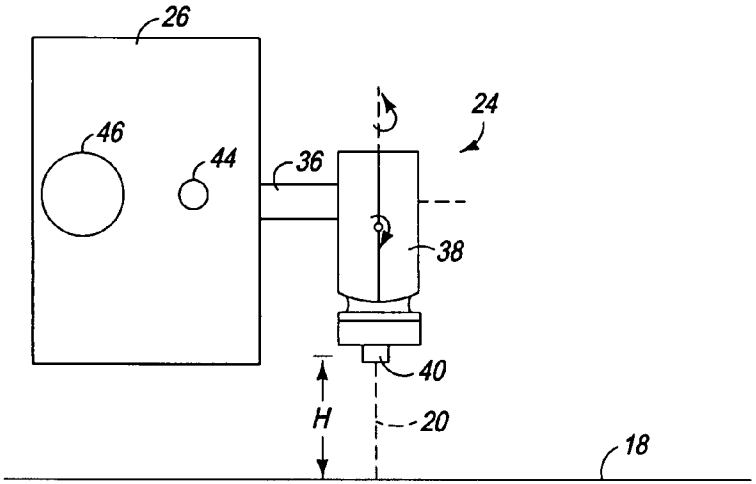
FIG. 3 is a side view of the carrier member and spray nozzle.

In the preferred embodiment, the slurry dispensing mechanism 22, as illustrated in FIGS. 2–3, includes a spray nozzle 24 operatively connected to a source of slurry (not shown), a carrier member 26, a lateral guide rail 28, a lateral actuating mechanism 30, a vertical actuating mechanism 32, and a longitudinal actuating mechanism 34. The actuating mechanisms 30, 32, 34 are selectively positionable in order to allow the spray nozzle 24 to translate in the longitudinal, lateral, and vertical directions. In addition, the spray nozzle 24 is operatively connected to the carrier member 26 such that the spray nozzle 24 can be selectively rotated about the longitudinal, lateral, and vertical axes. Therefore, the preferred embodiment of the slurry dispensing mechanism 22 is provided with six degrees of movement relative to the polishing pad 18 such that the user can selectively position the spray nozzle in order to evenly distribute slurry 20 to the polishing pad 18.

The slurry dispensing mechanism 22 is preferably disposed upstream from the wafer 12 being polished with respect to the direction of movement A of the polishing pad 18 such that the slurry 20 is applied to the polishing pad 18 prior to the CMP process, as illustrated in FIG. 2. Because the slurry 20 is dispensed onto the polishing pad 18 prior to the CMP process on a wafer 12, the application of slurry 20 improves the efficiency of the CMP process by providing a fresh layer of the polishing agent to the polishing pad 18. Additionally, by applying the slurry 20 to the polishing pad 18 prior to the CMP process, a polishing pad conditioner (not shown) can be utilized subsequent to the CMP process in order to remove any particles that may have become lodged or embedded in the polishing pad 18 during the CMP process. It should be understood by one skilled in the art that the slurry dispensing mechanism 22 can be located downstream from the wafer carrier 14 such that the application of slurry 20 to the polishing pad can act to assist in conditioning or dressing the pad while simultaneous by adding fresh slurry 20 to the polishing pad 18.

The spray nozzle 24 includes a mounting member 36, a main body 38, and a spray tip 40, as illustrated in FIG. 3. The mounting member 36 is operatively connected to the carrier member 26 and provides a hollow tubular structure in order to effectuate the transfer of slurry 20 to the main body 38 of the spray nozzle 24. The mounting member 36 extends in a generally horizontal direction from the carrier member 26 and generally parallel to the polishing pad 18. The mounting member 36 is preferably made of a hollow cylindrical tube of a flexible material. In an alternative embodiment, the mounting member 36 provides a structural passageway for a separate tube to be inserted therein (not shown) such that the inner tube effectuates the transfer of slurry 20 to the main body 38. It should be understood by one skilled in the art that the mounting member 36 can have any cross-sectional shape sufficient to carry slurry to the main body 38. The mounting member 36 is made of a material that is inert with respect to the polishing fluid, such as a thermoplastic, and preferably polyethylene terephthalate (also known as PET). It should be understood by one skilled in the art that the mounting member 36, or the tubular structure in direct contact with the slurry, can be made of any other material that will not have an adverse chemical reaction to the polishing fluid, or slurry 20 being used.

The mounting member 36 is preferably configured to provide rotational movement of the spray nozzle 24 relative to the carrier member 26. The mounting member 36 is flexible, and includes mechanisms that control the angular relationship of the spray nozzle 24. In operation, the user can selectively rotate the spray nozzle 24 about the vertical, lateral and longitudinal axes, as shown in FIG. 3, such that an actuator controls the mechanisms configured to adjust the spray nozzle 24. It should be understood by one skilled in the art that any mechanisms sufficient to provide three rotational degrees of movement between the spray nozzle and the carrier member can be used. In an alternative embodiment, the mechanisms controlling the mounting member 36 that defines the relative rotation of the spray nozzle 24 relative to the carrier member 26 can be controlled by software configure to adjust the relative rotation of the spray nozzle 24. Such software is capable of receiving input in the form of the removal profile of the surface of the wafer 12 and adjusting the rotational position of the spray nozzle 24 according to pre-determined algorithms. The rotational freedom of the spray nozzle 24 allows for the distribution of the slurry 20 to be adjusted such that an even distribution of slurry 20 is applied to the polishing pad 18 resulting in an even removal profile of the surface of the wafer 12.

The main body 38 of the spray nozzle 24 is operatively connected to the mounting member 36, as shown in FIG. 3, preferably having a generally vertical orientation with respect to the carrier member 26 and is attached to the mounting member 36. The main body 38 provides a pathway therethrough that allows the slurry 20 to flow from the mounting member 36 to the spray tip 40. The main body 38 is made of a material that is inert with respect to the slurry 20, and preferably of the same material as the mounting member 36. It should be understood by one skilled in the art that the main body 38 and the mounting member 36 can be manufactured as individual components or as a single components having the properties previously described. At a distal end of the main body 38, a spray tip 40 is attached such that the slurry 20 exits the spray nozzle 24 through the spray tip 49.

Figure 4A:
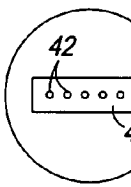
FIG. 4A is a bottom view of one embodiment of a spray tip on a spray nozzle.
Figure 4B:
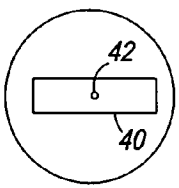
FIG. 4B is a bottom view of a second embodiment of a spray tip on a spray nozzle.
Figure 4C:
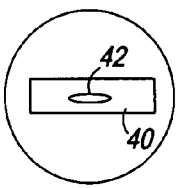
FIG. 4C is a bottom view of a third embodiment of a spray tip on a spray nozzle.

The spray tip 40 has at least one aperture 42 formed therein, as illustrated in FIGS. 4A–4C through which slurry 20 exits the spray nozzle 24 and is applied to the polishing pad 18. The spray tip 40 is made with a material that is inert with respect to the polishing fluid, and preferably is made of PET. In the preferred embodiment, shown in FIG. 3, the spray tip 40 extends in a downward direction from the main body 38 and is elongated in a direction substantially parallel to the transverse direction of the polishing pad 18. The downward-facing surface of the spray tip 40 preferably has a single aperture 42 formed therein, as illustrated in FIG. 4B. In an alternative embodiment, a plurality of apertures 42 can be formed in the spray tip 40, as illustrated in FIG. 4A. The aperture 42 is designed to generate a mist, or spray of slurry 20 from the spray nozzle 24 toward the polishing pad 18 in a predetermined manner, dependent upon the characteristics of the aperture 42. For example, an elongated aperture 42, as illustrated in FIG. 4C, may provide a spray of slurry 20 being wider in the transverse direction of the polishing pad 18 as well as covering a longer area with respect to the direction of movement of the polishing pad 18. It should be understood by one skilled in the art that the aperture or apertures formed in the spray tip may be of any shape or size sufficient to provide an even distribution of slurry on the polishing pad. It should also be understood by one skilled in the art that any number of apertures can be formed in the spray tip in order to provide an even distribution of slurry onto the polishing pad.

Figure 5:
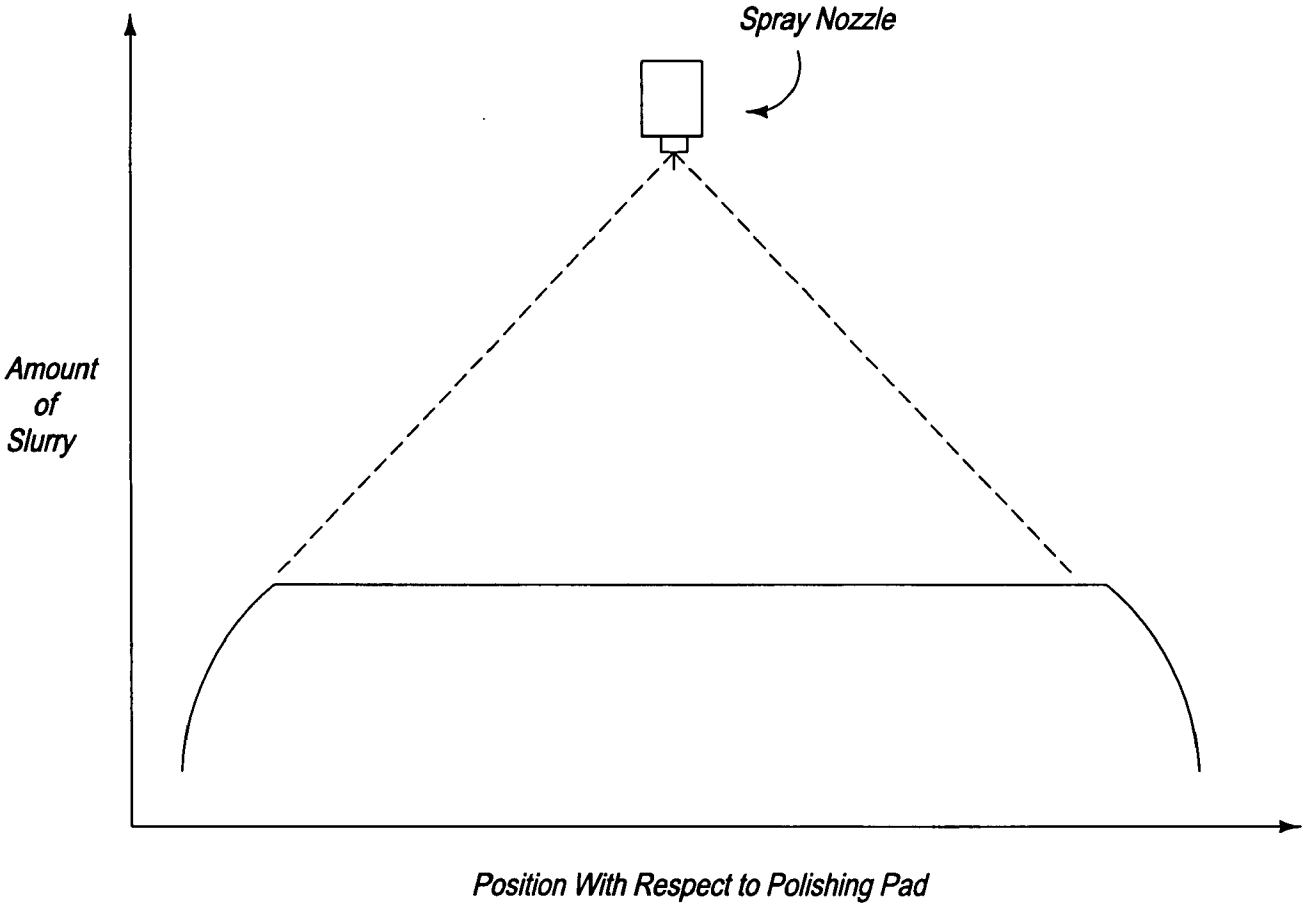
FIG. 5 is a graphical representation of the amount of slurry across the polishing pad from a spray nozzle.
Figure 10A:
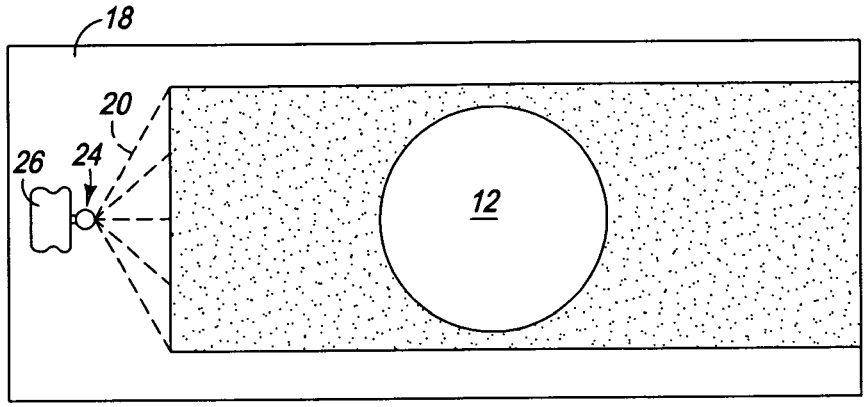
FIG. 10A is a top view of a spray nozzle distributing slurry onto a polishing pad.

In the preferred embodiment, the spray tip 40 has a single aperture 42 configured such that the spray of slurry 20 exiting the spray tip 40 is fan-shaped, as illustrated in FIGS. 2, 5 and 10A. The slurry 20 exits the spray tip as a stream of dispersed droplets, or a mist. The dispersed droplets of slurry 20 exit the spray tip 40 in a manner such that the pattern of slurry 20 on the polishing pad 18 forms a swath, or path between the opposing edges of the polishing pad 18. The swath of slurry 20 has a width W, and the width W is dependent upon the geometric configuration of the spray tip 40. The characteristics of the spray of slurry 20 are likewise dependent upon the geometric configuration of the spray tip 40. These characteristics include, but are not limited to, the size of the droplets, the angle at which the droplets exit the spray tip 40, the speed or pressure of the spray, and the relative dispersion of the droplets. It should be understood by one skilled in the art that the characteristics of the spray are also dependent upon the type of polishing fluid being used. The advantage of dispersing the slurry 20 in such a manner results in an even distribution of slurry 20 onto the polishing pad. The even distribution of slurry 20 onto the polishing pad 18 results in the swath of slurry 20 having a generally consistent thickness between the edges of width W of the swath, as illustrated in FIG. 5. Dispersing the slurry 20 by a spray directed toward the polishing pad 18 will tend to have droplets that are applied to the polishing pad 18 outside the intended width W of the swath of slurry 20, but it is intended that the thickness of the layer of slurry within the intended bounds of the swath is generally even, or constant, across the entire width W. By providing an even distribution of slurry 20 within a given width W on the polishing pad 28, a more even wear profile across the entire diameter of a wafer may be obtained.

In the preferred embodiment, the slurry dispensing mechanism 22 includes a single spray nozzle 24 having a single spray tip 40 attached thereto and directed toward the polishing pad 18 in order to provide a pattern of evenly distributed slurry 20 having a width W. In an alternative embodiment, the slurry dispensing mechanism 22 includes a second spray nozzle 24 for providing an even distribution of slurry 20 onto the polishing pad. The second spray nozzle is disposed directly upstream from the first spray nozzle 24 with respect to the movement of the polishing pad such that the first and second spray nozzles apply an even distribution of slurry 20 to the polishing pad 18 in series. The second spray nozzle is configured to provide a pattern of evenly distributed slurry to the polishing pad having a width that is less than the width W of the first spray nozzle. While both the first and second spray nozzles apply an even distribution of slurry across a width, because the respective widths are different the resulting distribution of slurry on the polishing pad will have more slurry concentrated centrally. In a further alternative embodiment, the second spray nozzle can be offset from the first spray nozzle such that the resulting pattern of slurry applied to the polishing pad is concentrated toward an edge of the width of the swath of applied slurry. It should be understood by one skilled in the art that any number of spray nozzles can be used for dispensing an even distribution of slurry by a spray such that the resulting distribution has a constant thickness across a width or the resulting distribution pattern includes areas of higher concentration of slurry in order to produce a particular wear profile of a wafer during the CMP process.

The width W of the application of slurry 20 is dependent upon both the height of the spray nozzle 24 and the geometry of the aperture 42 formed in the spray tip 40. Because the slurry 20 is exiting the spray tip 40 in the shape of a fan, there will be a decrease in the amount of slurry 20 at the outer edges of the swath of slurry 20 on the polishing pad 18, as illustrated in FIG. 5. Thus, it should be understood by one skilled in the art that the swath of slurry 20 applied to the polishing pad 18 be of sufficient width such that the diameter of the wafer 12 resides within the portion of the swath having an even distribution of slurry 20. The slurry dispensing mechanism 22 is configured to allow for the translational adjustment of the spray nozzle 24 in order to position the swath of slurry 20 applied to the polishing pad 18 such that the diameter of the wafer 12 is wholly within the width W of the swath of dispensed slurry 20.

The spray of slurry 20 being dispersed from the spray tip 40 preferably generates a constant stream of droplets being distributed to the polishing pad to produce a pattern of slurry applied thereto. The constant stream of slurry 20 is preferred so that the entire width W of the pattern of slurry 20 applied to the polishing pad 18 is continuous and uninterrupted so as to not leave a portion of the polishing pad 18 coming into contact with the rotating wafer 12 without slurry 20 in order to aid in the substrate removal.

The geometric characteristics of the aperture 42 or apertures formed in the spray tip 40 can be dependent upon the type of polishing fluid being employed for a particular CMP process. For example, if the CMP process is utilizing a homogenous liquid as the polishing fluid, the aperture 42 formed in the spray tip 40 may be very small in order to provide a high-pressure spray. However, if the CMP process is utilizing a colloid having microabrasives, the same spray tip 40 may become clogged by the microabrasives in the polishing fluid. Thus, a large aperture 42 may be formed through the spray tip 40 in order to allow the polishing fluid to be dispersed to produce substantially the same distribution of polishing fluid on the polishing pad 18.

The spray nozzle 24 is operatively connected to the carrier member 26, as illustrated in FIG. 2, which provides the spray nozzle 24 lateral, or transverse, movement relative to the polishing pad 18. The carrier member 26 has a first hole 44 and a second hole 46 formed therethrough for cooperation with the lateral actuating mechanism 30 and a lateral guide rail 28, as shown in FIG. 3. The first hole 44 and second hole 46 are generally oriented in a parallel manner with respect to each other, and the holes 44, 46 extend through the width of the carrier member 26 and in a direction transverse to the polishing pad 18. The spray nozzle 24 extends from the forward distal end of the carrier member 26, and the second hole 46 is formed through the rear portion of the carrier member 26 with the first hole 44 formed therebetween.

The lateral guide rail 28 extends in a generally transverse direction with respect to the polishing pad 18, and preferably extending over at least the width of the polishing pad 18, as illustrated in FIG. 2. The lateral guide rail 28 provides a guide on which the carrier member 26 is allowed to travel in order to provide the slurry dispensing system 22 with lateral, or transverse adjustability relative to the polishing pad 18. The lateral guide rail 28 is disposed within the first hole 44 formed in the carrier member 26. The shape of the cross-section of both the lateral guide rail 28 and the first hole 44 are preferably the same in order to provide a secure connection between the carrier member 26 and the lateral guide rail 28. Preferably, either the outer radial surface of the lateral guide rail 28 or the inner radial surface of the first hole 44 is coated with a material, such as Teflon®, in order to provide a generally frictionless connection.

As shown in FIG. 2, the carrier member 26 is operatively connected to the lateral actuating mechanism 30 that is configured to actuate the carrier member 26 along the lateral guide rail 28. In the preferred embodiment, the lateral actuating mechanism 30 includes a screw gear 48, a first vertical support 50, a second vertical support 52, and a first power source 54, as shown in FIG. 2. The first and second vertical supports 50, 52 are disposed on opposing edges of the polishing pad 18 and extend vertically therefrom. The screw gear 48 is configured to be operative connect to and extend between the vertical supports 50, 52 such that the screw gear 48 is oriented in a generally normal direction relative to the movement of the polishing pad 18. For example, in a wafer polisher 10 utilizing a linear polishing pad, the screw gear 48 is oriented perpendicular to the longitudinal direction of the pad, and in a wafer polisher 10 utilizing a radial disk, the screw gear 48 is oriented as a radius or diameter of the radial disk with respect to the center of the disk. It should be understood by one skilled in the art that a single vertical support can be used to position the lateral actuating mechanism in a cantilevered manner above the polishing pad. The screw gear 48 is disposed within the second hole of the carrier member 26. The outer radial surface of the screw gear 48 and the inner radial surface of the second hole 46 formed in the carrier member 26 preferably form a meshing engagement between the carrier member 26 and the lateral actuating mechanism 30. The first power source 54 is operatively connected to a distal end of the screw gear 48 in order to drive the rotation of the screw gear 48 in both a clockwise and counter-clockwise manner about the longitudinal axis of the screw gear 48. The opposing distal end of the screw gear 48 opposite the end of the screw gear 48 operatively connected to the first power source 54 is unconstrained. The meshing engagement between the carrier member 26 and the screw gear 48 is configured such that the rotation of the screw gear 48 results in translation of the carrier member 26 along the longitudinal axis of the screw gear 48 and the lateral guide rail 28.

In operation, the user can selectively position the spray nozzle 24 in the lateral direction with respect to the direction of movement of the polishing pad 18 by providing power to the first power source 54 to driver the rotation of the screw gear 48 such that the meshingly engaged surfaces of the screw gear 48 and the carrier member 26 cause the carrier member 26 to translate along the length of the screw gear 48 and the lateral guide rail 28. The rotation of the screw gear 48 in the clockwise direction about the longitudinal axis preferably actuates the carrier member 26 in a direction away from the distal end of the screw gear 48 operatively connected to the first power source 54, and the rotation of the screw gear 48 in the counter-clockwise direction about the longitudinal axis actuates the carrier member in a direction toward the distal end of the screw gear 48 operatively connected to the first power source 54. It should be understood by one skilled in the art that the outer radial surface of the screw gear 48 and the inner radial surface of the carrier member 26 can be configured such that the clockwise rotation of the screw gear 48 can cause the carrier member 26 is actuated in the direction toward the distal end of the screw gear 48 operatively connected to the first power source 54, and the counter-clockwise rotation of the screw gear 48 can also cause the carrier member 26 to be actuated in the direction away from the distal end of the screw gear 48 operatively connected to the first power source 54. It should be understood by one skilled in the art that any other actuating mechanism sufficient to cause the translation of the carrier member along the longitudinal length of the lateral guide rail can be used. It should also be understood that the lateral actuating mechanism 30 can be selectively positioned based upon user-controlled input or by software having algorithms for determining the optimum lateral position of the spray nozzle relative to the polishing pad 18.

Figure 6:
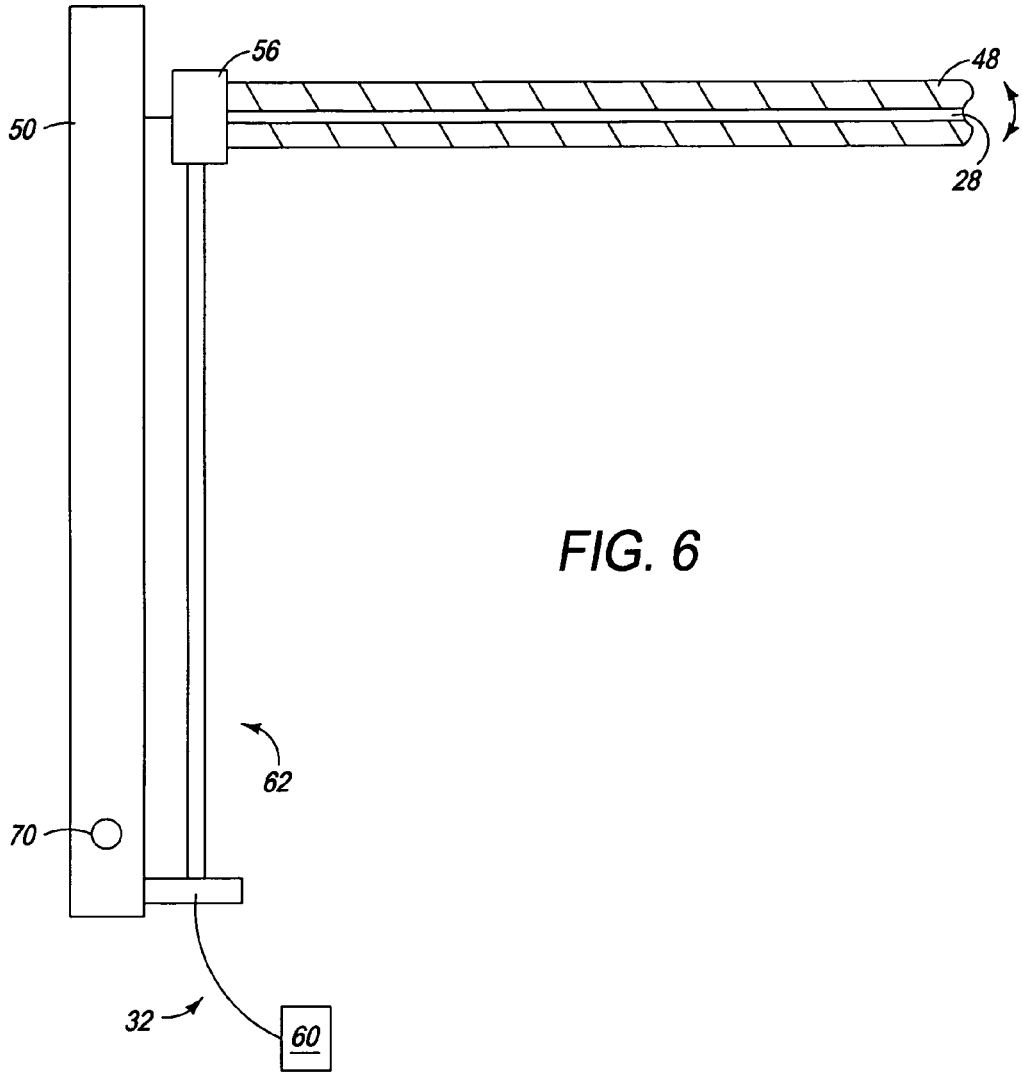
FIG. 6 is a front sectional view of one embodiment of a vertical actuating mechanism.

The opposing distal ends of the screw gear 48 are operatively connected to the vertical actuating mechanism 32, as shown in FIG. 2. The vertical actuating mechanism 32 works in conjunction with the structures of the lateral actuating mechanism 30 in order to allow the height of the spray nozzle 24 to be adjusted relative to the polishing surface of the polishing pad 18. The vertical actuating mechanism 32 includes a first receiving member 56, a second receiving member 58, and a second power source 60. The first and second receiving member 56 are configured to receive the opposing distal ends of the screw gear 48 and allow for the screw gear 48 to rotate about the longitudinal axis thereof. The first and second receiving member 56 are operatively connected to the first and second vertical supports 50, 52 such that the second power source 60 causes the first and second receiving members 56 to be actuated along the vertical length of the first and second vertical supports 50, 52. In one embodiment, illustrated in FIG. 6, the second power source 60 is operatively connected to a hydraulic system 62 that is attached to the first and second receiving members 56, 58 such that the hydraulic system 62 raises and lowers the first and second receiving members 56, 58 relative to the polishing pad 18, thereby selectively positioning the spray nozzle 24 in the vertical direction.

Figure 7:
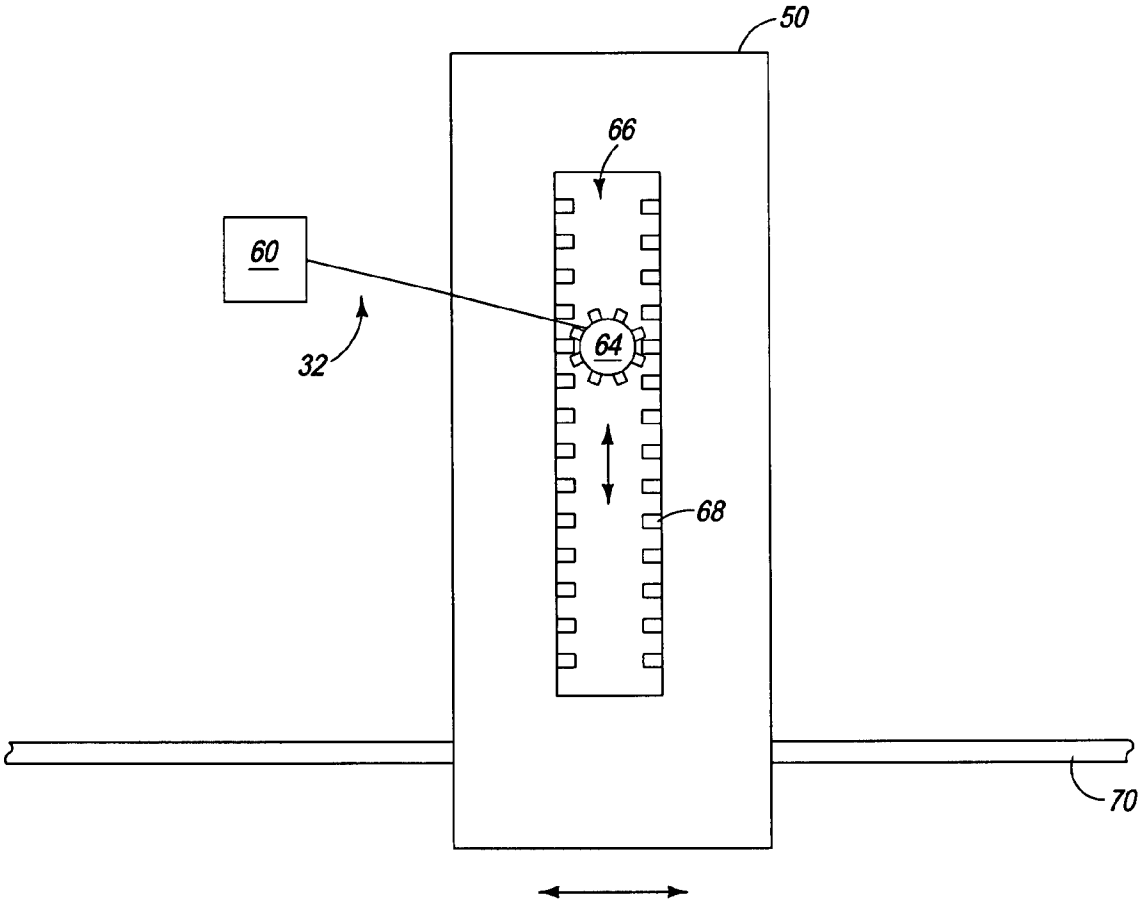
FIG. 7 is a side sectional view of a second embodiment of a vertical actuating mechanism.

In an alternative embodiment, shown in FIG. 7, a rotatable pinion gear 64 extends laterally from both the first and second receiving members 56, 58. The pinion gear 64 is received within a vertical slot 66 formed in each of the first and second vertical supports 50, 52. The vertical slot 66 includes a rack 68 disposed on the opposing inner edges of the vertical slot 66 such that the pinion gear 64 is meshingly engaged with the pair of racks 68, thereby forming a rack-and-pinion connection between the first and second receiving members 56, 58 and the first and second vertical supports 50, 52. The second power source 60 is configured to rotate the pinion gear 64, thereby actuating the first and second receiving members 56, 58 in the vertical direction. It should be understood by one skilled in the art that any mechanism capable of actuating the spray nozzle 24 in a generally vertical direction can be used. It should also be understood that the vertical actuating mechanism 32 can be selectively positioned based upon user-controlled input or by software having algorithms for determining the optimum vertical position of the spray nozzle relative to the polishing pad 18.

The longitudinal actuating mechanism 34 likewise acts in conjunction with the lateral actuating mechanism 30 to provide adjustability of the spray nozzle 24 in the direction of movement of the polishing pad 18 and relative to the wafer carrier 14. The longitudinal actuating mechanism 34, illustrated in FIGS. 2 and 6–7, includes a first longitudinal guide rail 70, a second longitudinal guide rail 72, and a third power source 74. The first and second longitudinal guide rails 70, 72 are disposed on opposing sides of the polishing pad 18, and each longitudinal guide rail 70, 72 is oriented in a generally parallel manner with respect to the opposing longitudinal guide rail. The first longitudinal guide rail 70 is disposed within a corresponding aperture formed in the first vertical support 50, and the second longitudinal guide rail 72 is disposed within a corresponding aperture formed in the second vertical support 52. The longitudinal adjustment results from the first and second vertical supports 50, 52 being actuated along the length of the first and second longitudinal guide rails 70, 72 such that the spray nozzle 24 is moved toward and away from the wafer carrier 14. The third power source 74 drives the longitudinal actuating mechanism 34 so as to provide the fore-aft movement of the spray nozzle 24. It should be understood by one skilled in the art that any mechanism capable of actuating the spray nozzle 24 in a generally longitudinal direction can be used. It should also be understood that the longitudinal actuating mechanism 34 can be selectively positioned based upon user-controlled input or by software having algorithms for determining the optimum longitudinal position of the spray nozzle relative to the wafer carrier 14. Furthermore, it should be understood by one skilled in the art that a single power source can be used to drive each of the first, second, and third actuating mechanisms 30, 32, 34, and that any power source known by one skilled in the art that is capable of driving the actuating mechanisms can be used.

In operation, the spray nozzle 24 can be selectively positioned through translational movement in each of the three axial directions as well as rotation about three axes of rotation. The mounting member 36 acts in concert with the three actuating mechanisms 30, 32, 34 to allow the spray nozzle 24 to be adjusted relative to the polishing pad 18 in order to dispense a spray of slurry 20 evenly across the polishing pad 18. The ability to adjust the relative position of the spray nozzle 24 and the geometric configurations of the spray tip 40 resulting in an even distribution of slurry 20 is a significant advantage over the prior method of distributing polishing fluid onto a polishing pad. An even distribution of slurry 20 across the polishing pad 18 results in an even wear profile on the surface of wafer 12 being polished by the CMP process.

Figure 8:
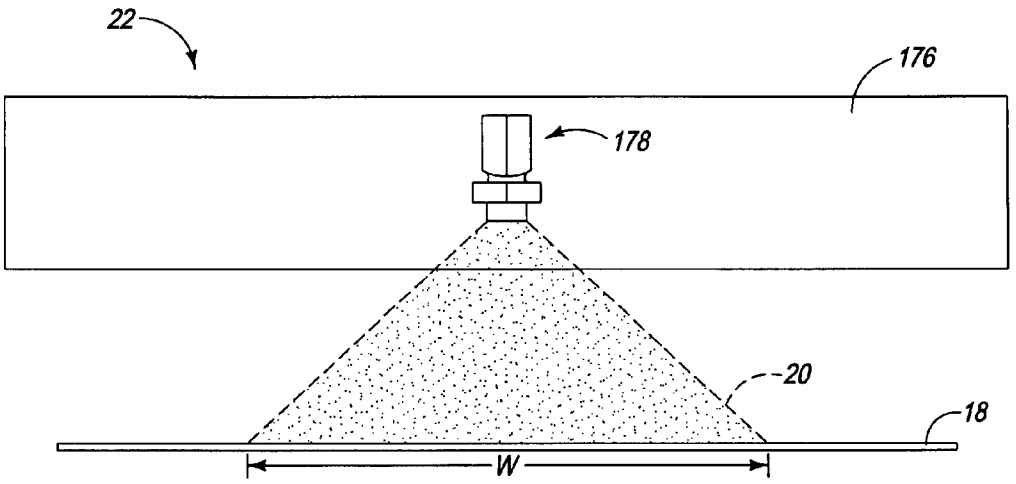
FIG. 8 is a front view of a second embodiment of a slurry delivery system.

In an alternative embodiment of the slurry dispensing mechanism 22, as illustrated in FIG. 8, includes an elongated manifold 176 and a spray nozzle 178 attached thereto. The manifold 176 is disposed vertically above the polishing surface of the polishing pad 18 and is oriented in the direction transverse to the direction of movement of the polishing pad 18. The manifold 176 is configured to provide structural support for the slurry dispensing mechanism 22 in order to maintain the position of the slurry dispensing mechanism relative to polishing pad. The slurry 20 is transferred from a source of slurry (not shown) to the spray nozzle 178 by way of a pump. The manifold 176 is configured to extend across the entire width of a linear polishing pad 18. It should be understood by one skilled in the art that when the slurry dispensing mechanism 22 is used in conjunction with other types of polishing pads, such as a radial disk for example, the manifold 176 should be of sufficient length so that the spray nozzle 178 can provide an even distribution of slurry 20 having a width W at least equal to the diameter of the wafer 12 being polished.

The slurry dispensing mechanism 22, as shown in FIG. 8, includes a spray nozzle 178 extending from the manifold 176 but any number of spray nozzles can be connected to the manifold in order to provide uniform distribution of slurry 20 on the polishing pad 18. The spray nozzle 178 extends in a lateral direction away from the downstream edge of the manifold 176 at a point located centrally between the opposing ends of the manifold 176, but can also be configured to extend from the upstream side of the manifold 176 or extend from the bottom, downwardly-facing surface of the manifold 176.

During the CMP process, the polishing pad 18 moves in a translating manner, in the case of a linear belt, or rotates, in the case of a radial disk, as the wafer carrier 14 simultaneously causes the wafer 12 to rotate. The rotation of the wafer 12 in conjunction with the movement of the polishing pad 18 and the slurry 20, or polishing agent, causes minute particles to be removed from the surface of the wafer 12. Preferably, the removal rate of these particles from a wafer 12 is consistent across the entire surface of the wafer 12 being polished, but the removal rate is typically greater at the edges of the wafer due to the downforce of the wafer 12 onto the polishing pad 18.

Figure 9:
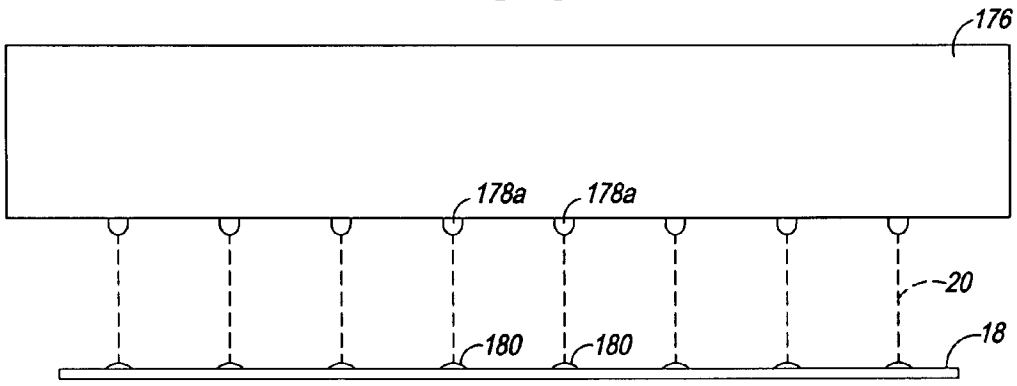
FIG. 9 Prior Art
FIG. 9 is a front view of a slurry delivery system as used in the prior art.
Figure 10B:
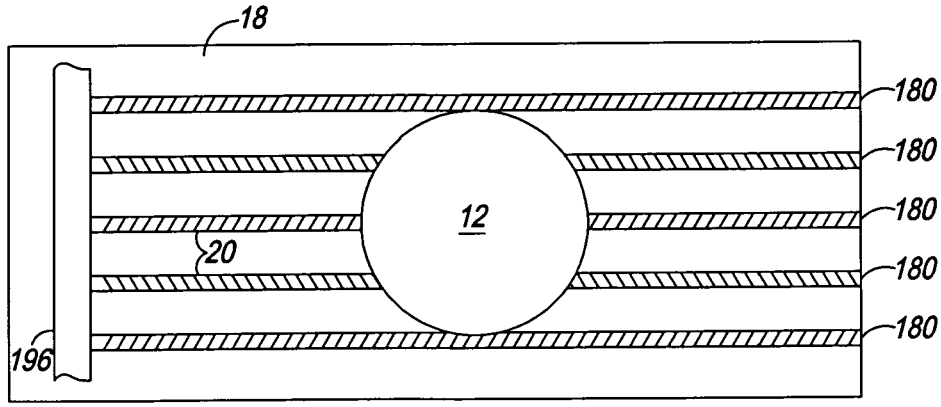
FIG. 10B Prior Art
FIG. 10B is a top view of the prior art slurry distribution system distributing slurry only a polishing pad.

Historically, the typical application of slurry 20 to the polishing pad 18 involved dripping slurry 20 from a plurality of nozzles 178*a* attached to the manifold 176, as shown in FIG. 9. This method of applying slurry 20 to the polishing pad 18 creates trails 180 of slurry 20 along the polishing pad 18 directly beneath the nozzle 178*a* from which the slurry 20 was dripped, as illustrated in FIGS. 9 and 10B. In contrast, the spray nozzle 24, as shown in FIG. 10A, extends from the carrier member 26 and is configured to provide a spray of slurry 20 exiting from the spray nozzle 24 to generate a swath of slurry 20 on the polishing pad 18 so as to avoid creating the trails 180 of slurry that result from dripping the slurry onto the polishing pad. The use of a spray nozzle 24 is advantageous over dripping the slurry 20 from nozzles 178*a* because the spray nozzle 24 provides an even, uniform pattern of slurry distributed across a pre-determined swath of the polishing pad 18. One advantage of providing and evenly distributed pattern of slurry 20 on the polishing pad 18 by the method of spraying is that by spraying the slurry 20 onto the polishing pad 18, the slurry is evenly distributed across a width W of the polishing pad prior to contact with the rotating wafer 12. In contrast, the method of dripping the slurry 20 onto the polishing pad 18 requires the rotation of the wafer 12 to distribute the slurry in the slurry trails 180 across the polishing pad 18 and such distribution of the slurry may not produce an even distribution of the slurry across the entire diameter of the wafer.

The removal rate of substrate from the wafer 12 during the CMP process is dependent upon a number of factors including, but not limited to, the downforce from wafer carrier 14 to the wafer 12 onto the polishing pad 18, the speed of the polishing pad 18, the speed of rotation of the wafer carrier 14, and the slurry distribution. The structural limitations of the wafer 12 limit the ability to adjust the downforce, the speed of the polishing pad, and the rotational speed of the wafer carrier 14. Typical limits of the CMP process include a polishing pad speed between about fifty to eight hundred feet per minute (50–800 ft/min), rotation of the wafer carrier between about 1 and fifty revolutions per minute (1–50 rpm), flow rate of the slurry between about fifty to 500 milliliters per minute (50–500 ml/min), and a downforce from the wafer carrier to the polishing surface between about one-tenth and eight pounds per square inch (0.1–8 psi). The user has the ability to fine-tune slurry distribution system in order to improve the resulting semiconductor wafer surface of the CMP process. The spray nozzle 24 provides numerous adjustable variables for adjusting the slurry distribution including, but not limited to, the pressure of the spray of slurry, the height of the spray nozzle above the polishing pad, the angle of the spray nozzle with respect to the polishing pad, the rate of flow of the slurry from the spray nozzle, and the shape or pattern of the spray of slurry as it exits the spray tip 40.

The height H of the spray tip 40 from the polishing surface of the polishing pad 18, as illustrated in FIG. 3, can be adjusted by the vertical actuating mechanism 32. Because the spray of slurry 20 exiting the spray tip 40 is preferably fan-shaped, the height H of the spray nozzle 24 above the polishing pad 18 will determine the width W of the swath of slurry 20 applied to the polishing pad 18. The closer the spray nozzle 24 is located to the polishing pad 18, the smaller the width W of the swath of slurry 20 being applied to the polishing pad 18, and the further away from the polishing pad, the larger the width of the swath of slurry 20. The height H of the spray tip 40 above the polishing surface of the polishing pad is preferably between about one-half and twelve inches (0.5–12"), and more particularly between about five to six inches (5–6"). The ideal height H at which the spray nozzle is located above the polishing pad 18 is dependent upon the geometry and the type of spray tip 40 being used. The height H may also depend upon the angle at which the spray nozzle 24 is positioned relative to the polishing pad 18.

While the slurry distribution system 22 is configured to produce a pattern, or swath of slurry 20 having a constant thickness across a width W on the polishing pad 18, it should be understood by one skilled in the art that the relative thickness of the distribution of slurry 20 across the width W may need to be varied in order to assist in obtaining an even removal rate from the wafer 12 being polished. The angle of the spray nozzle 24 relative to the polishing pad 18 can be adjusted by the rotational movement of the mounting member 36. By rotating the spray nozzle 24 about the longitudinal axis, the width of the slurry 20 applied to the polishing pad 18 can be shifted toward one edge of the polishing pad 18. Also, if the spray nozzle 24 is rotated about the longitudinal axis, the thickness of the slurry 20 applied to the polishing pad 18 will be thicker at one edge of the width than the opposing edge. This may be necessary if the polishing process results in an uneven wear profile of the wafer 12 such that additional slurry is required near the edge of the wafer 12 as opposed to the center of the wafer 12 in order to generate an even wear profile. It should be understood by one skilled in the art that the rotational movement of the spray nozzle 24 can alter the relative distribution pattern of the slurry 20 in order to produce a more even wear profile of the wafer 12.

The pressure of the slurry 20 exiting the spray tip 40 can also be adjusted in order to alter the parameters of the slurry dispensing mechanism 22 in order to produce an even distribution of slurry 20. Typically, the slurry 20 is transferred to the spray nozzle 24 by way of a peristaltic pump (not shown). It should be understood by one skilled in the art that any type of pump sufficient for transferring slurry 20 between a source of slurry and the slurry dispensing mechanism 22 can be used. The characteristics of the pump dictate the flow rate of the slurry 20 as it is dispersed onto the polishing pad 18. The pressure of the slurry 20 being expelled from the spray tip 40 is dependent upon the geometry of the aperture 42 formed therein. For example, for the same flow rate of slurry 20, the slurry 20 being distributed by a spray tip 40 having a single, round aperture 42 formed therein, as illustrated in FIG. 4B, will be exiting the spray tip 40 at a higher pressure than a spray tip 40 having a longer, elongate aperture 42 formed therein, as illustrated in FIG. 4C. Thus, the pressure of the slurry 20 can be adjusted by changing the geometry of the spray tip 40. The flow rate of the slurry 20 can likewise be adjusted by changing the type of pump used to transfer the slurry 20 from the slurry source to the spray nozzle 24.

It should be understood that the adjustment of the spray nozzle as previously described preferably produces an even distribution of slurry 20 on the polishing pad 18, the slurry dispensing mechanism 22 is also capable of adjusting the position of the spray nozzle 24 such that a slightly uneven application of slurry 20 is produced that results in the even substrate removal profile across the surface of the wafer 12 during the CMP process.

Figure 11A:
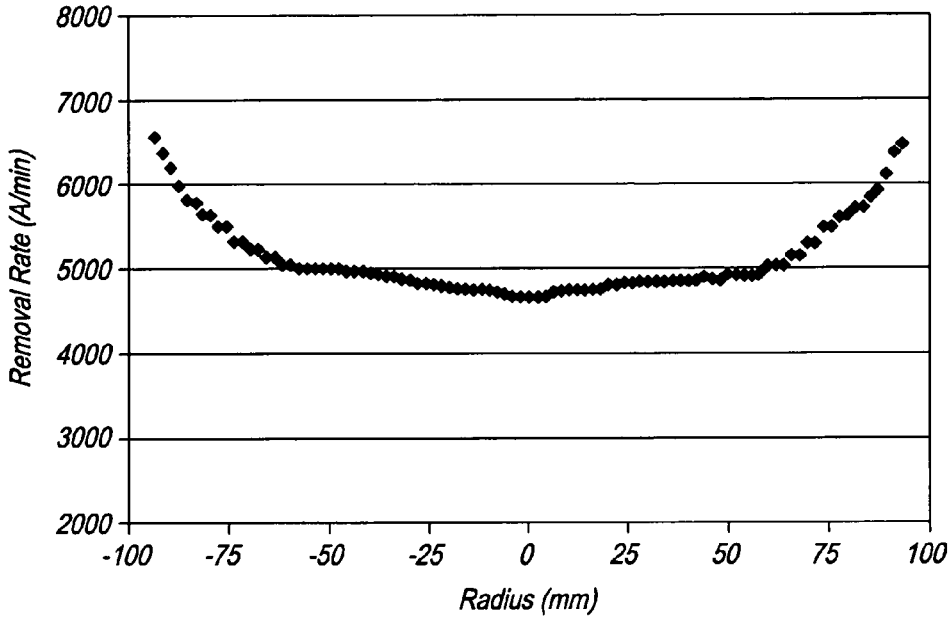
FIG. 11A is a graphical depiction of an exemplary wear profile from a wafer utilizing the slurry delivery system illustrated in FIG. 10A.
Figure 11B:
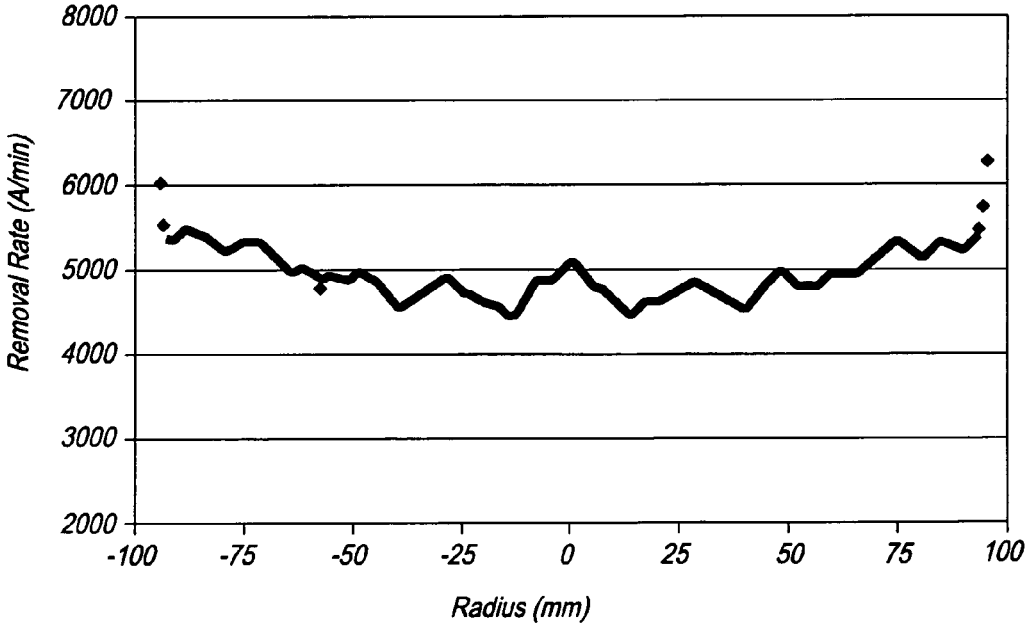
FIG. 11B is a graphical depiction of an exemplary wear profile from a wafer utilizing the slurry delivery system illustrated in FIG. 10B.

FIGS. 11A and 11B illustrate two different wear, or removal profiles of a wafer during a CMP process. For both exemplary profiles, the testing conditions were consistent, having the same fixed parameters including: a belt speed of 300 ft/min, the wafer carrier rotating the wafer at 20 rpm, slurry flow rate of 200 mil/min, and a downforce of the wafer carrier of 4 psi. The only difference between the results of the CMP process illustrated in the exemplary diagrams of FIGS. 11A and 11B is the method of slurry delivery. The method of applying slurry to the polishing pad by using a spray nozzle 28, shown in FIG. 10A, resulted in the removal profile of FIG. 11A, and the method of applying slurry to the polishing pad by dripping from a plurality of nozzles 178*a*, shown in FIG. 10B, resulted in the removal profile of FIG. 11B. These exemplary figures illustrate the improved removal profile during the CMP process as a result of applying the slurry by way of a spray nozzle that evenly distributes the slurry across the polishing pad.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

It is therefore intended that the foregoing detailed description be regarded as illustrative rather than limiting, and that it be understood that it is the following claims, including all equivalents, that are intended to define the spirit and scope of this invention.

The invention claimed is:

1. An adjustable polishing fluid dispensing mechanism for use in chemical mechanical planarization of a semiconductor wafer utilizing a polishing pad, said polishing fluid dispensing mechanism comprising:

a spray nozzle, wherein said spray nozzle includes a mounting member, a main body connected to said mounting member, and a spray tip extending from said main body and said spray tip having an aperture formed therethrough for dispensing a spray of a polishing fluid;

a carrier member, said mounting member being flexibly connected to said carrier member and said flexible connection between said carrier member and said mounting member provides said spray nozzle with rotational movement relative to said carrier member;

a lateral actuating mechanism, said lateral actuating mechanism operatively connected to said carrier member, and said lateral actuating mechanism configured to provide lateral translation of said carrier member relative to said polishing pad;

a vertical actuating mechanism, said vertical actuating mechanism operatively connected to said carrier member, and said vertical actuating mechanism configured to provide vertical translation of said carrier member relative to said polishing pad;

and a longitudinal actuating mechanism, said longitudinal actuating mechanism operatively connected to said carrier member, and said longitudinal actuating mechanism configured to provide longitudinal translation of said carrier member relative to said polishing pad.

* * * * *